US005273002A

United States Patent [19]

Balint et al.

[11] Patent Number: 5,273,002

[45] Date of Patent: Dec. 28, 1993

[54] WATER TUBE BOILER

[75] Inventors: Endre Balint, Bålsta; Erik Andersson, Sodertalje, both of Sweden

[73] Assignee: Gadelius Sunrod AB, Sweden

[21] Appl. No.: 949,831

[22] PCT Filed: Dec. 19, 1991

[86] PCT No.: PCT/SE91/00883

§ 371 Date: Nov. 10, 1992

§ 102(e) Date: Nov. 10, 1992

[87] PCT Pub. No.: WO92/18806

PCT Pub. Date: Oct. 29, 1992

[30] Foreign Application Priority Data

Apr. 10, 1991 [SE] Sweden ..... 9101073

[51] Int. Cl.[5] ..... F22B 33/00

[52] U.S. Cl. ..... 122/20 B; 122/7 R; 122/235.11; 122/235.15; 122/367.3

[58] Field of Search ..... 122/7

[56] References Cited

U.S. PATENT DOCUMENTS 3,559,624 12/1971 Sheikh ..... 122/235.11

4,422,411 12/1983 Thorogood ..... 122/20 B

FOREIGN PATENT DOCUMENTS 596805 5/1934 Fed. Rep. of Germany .... 122/20 B

*Primary Examiner*—Edward G. Favors

*Attorney, Agent, or Firm*—Ostrolenk, Faber, Gerb & Soffen

[57] ABSTRACT

A water tube boiler comprises a furnace having a burner and a vertical flue gas stack located to one side of the furnace. A convection tube assembly is arranged in the stack for the recovery of heat from flue gases passing through the flue gas stack. With the object of facilitating any repair work needing to be performed on the convection tube assembly, the tube assembly comprises by a plurality of parallel rows of vertical convection tubes which are provided externally with surface enlarging elements e.g. in the form of pins, along part of the height of each tube. The tubes in each row are joined together to form a coherent flat unit with the aid of a respective upper, horizontal header to which all convection tubes in the row are connected at their upper ends, and a respective lower horizontal manifold to which the bottom ends of the tubes in the row are connected. The headers of the various units are connected individually to a steam drum of the boiler and their manifolds are connected individually to a stuff box in the boiler. The heights of the headers and manifolds for adjacent flat tube units across the stack respectively alternate in height vertically.

15 Claims, 4 Drawing Sheets

WATER TUBE BOILER

BACKGROUND OF THE INVENTION

The present invention relates to a water tube boiler, particularly of the type comprising a furnace having at least one burner located in its upper part to generate a generally downwardly directed flame into the furnace, a substantially vertical flue gas stack located close to one side of the hearth and having an inlet for the flue gases at its lower part which is situated in a lower part of the furnace, an outlet for flue gases located at its upper part, a convection tube assembly arranged in the stack for the recovery of heat from flue gases passing through the flue gas stack.

In conventional steam boilers of this type, the convection tube assembly arranged in the flue gas stack generally consists of a plurality of layers of substantially horizontal tubes located one above the other. Occasionally substantially vertical convection tubes have been used. However, the efficiency of the convection part of that boiler has been comparatively low. Both types of known constructions have been found in practice to be highly unfavourable regarding the extent of and difficulty in performing the operations required to repair the convection tube assembly after the appearance of a leak in any tubes.

SUMMARY OF THE INVENTION

The object of the invention is to effect an improved water tube boiler of the type described which enables repair work on the convection tube assembly to be performed in a considerably simpler and quicker manner than was previously possible.

The boiler according to the invention has its convection tube assembly comprising a plurality of parallel rows of substantially vertical convection tubes extending along a substantial portion of the length of the flue gas stack and the tubes are provided externally with surface enlarging elements. The tubes in each row are joined together to form a flat coherent unit with the aid of an upper, substantially horizontal header to which the upper ends of all convection tubes in the row are connected, and a lower, substantially horizontal manifold to which the lower ends of the convection tubes are connected. The headers of the various units are connected individually to a steam drum of the boiler, and their manifolds are connected individually to a stuff box in the boiler.

By this construction of the convection tube assembly, when a leak occurs in a convection tube, the flat unit comprising a row of convection tubes which includes the damaged tube can be cut free and removed from the flue gas stack. The damaged tube can then easily be repaired or replaced by a new tube. The flat unit of convection tubes can be cut free by cutting each of the two tubes connecting the unit's header with the steam drum and its manifold to the stuff box of the boiler. Furthermore, providing the convection tubes with external surface enlarging elements avoids the drawback of previously known steam boilers having substantially vertical convection tubes, i.e. low efficiency in the convection part of the boiler, and instead enables high efficiency there.

With the object of reducing the resistance of the substantially horizontal headers and manifolds in the convection tube units to the upwardly directed flow of flue gases in the stack, both headers and manifolds may be arranged mutually displaced in a substantially vertical direction between adjacent units. The headers and manifolds are suitably arranged displaced in alternate upward and downward directions between the various units.

To facilitate advantageous placement of suitable mechanical supports for the convection tubes and equipment necessary for soot blasting, the convection tubes may be provided externally with surface enlarging elements only along selected portions of their length. In this case, they may suitably be provided between such parts with parts which are free from external surface enlarging elements.

The distance of diversions between the convection tubes may suitably be the same within each unit and between the various units. This ensures uniform distribution of the convection tubes throughout the entire cross-sectional area of the flue gas stack.

In a preferred embodiment of the invention the surface enlarging elements are formed by pins applied on the convection tubes and projecting generally radially from them. If the distance of divisions between the convection tubes as mentioned above is the same within each unit as it is between the various units, the outermost ends of the pins on each convection tube along at least parts of the tube length may be located along the sides of a described rectangle. Each convection tube may then be provided with pins directed toward the corners of the described rectangle, those pins being longer than the pins located between them. Preferably, at least some of the pins on each convection tube are bent in such a manner that they extend obliquely towards the upper end of the tube.

The invention is described in detail below with reference to the accompanying drawings in which

DESCRIPTION OF A PREFERRED EMBODIMENT

Figure 1:
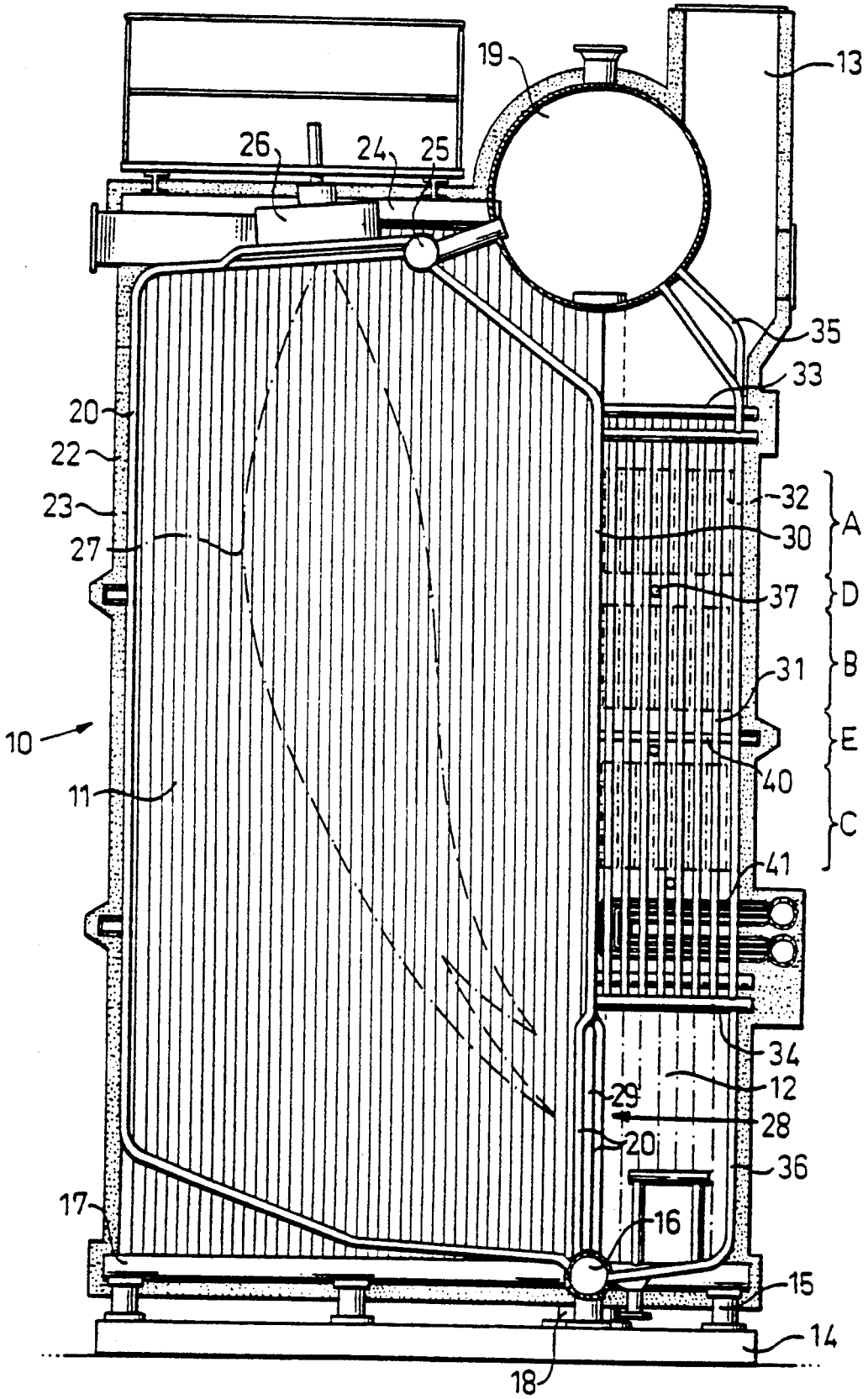
FIG. 1 exemplary shows a side view, in section, of a steam boiler according to one embodiment of the invention.

The steam boiler 10 constitutes a water tube boiler having a substantially rectangular shape in both a horizontal and a vertical projection. A furnace 11 is located in a front part of the boiler, and a vertical flue gas stack 12 is located in a rear part. A stack is provided at its upper end with a flue gas outlet 13. The boiler 10 is mounted on a foundation 14 on which it rests supported partly by a number of supports 15 carrying stuff boxes 16 and 17 which are located at the lower end of the boiler and partly by the lower ends of two downers 18, the upper ends of which support the steam drum 19 of the boiler.

The furnace 11 is limited laterally, forward and rearward by panel tube walls consisting of rows of equally spaced tubes 20 connected together by means of intermediate waist plates 21. The flue gas stack 12 is also limited laterally, forward and rearward by similar panel tube walls. The exterior of the boiler lo is covered with a layer 22 of heat insulating material and then with a layer 23 of sheet metal.

The panel tubes 20 located around the hearth 11 are connected by their upper ends to the steam drum 19 by way of header boxes 24 and 25, and by their lower ends to the previously mentioned stuff boxes 16 and 17, respectively. These stuff boxes communicate with the two downers 18 to receive water flowing down through the downers from the steam drum 19 and distribute it to the various panel tubes 20 through which the water, being partially vaporized, flows up by auto-circulation to the header boxes 24 and 25, respectively, and from there to the steam drum 19.

A burner for gas or oil is located at the upper end of the furnace 11. It is arranged to produce a generally downwardly directed flame 27, indicated by broken lines, into the furnace. The flue gases produced upon combustion of the fuel consisting of gas or oil are withdrawn from the hearth 11 to the flue gas stack 12 through a flue gas inlet 28, located in the lower part of the stack and having its orifice in the hearth. The flue gases then pass up through the flue gas stack to the outlet 13 located at the upper end of the stack.

The flue gas inlet 28 is formed by a large number of gap openings 29 between adjacent tubes 20 in the lower part of the partition 30 in the form of a panel tube wall located between the furnace 11 and the flue gas stack 12. These openings 29 are provided by omitting the waist plates 21 normally present between the tubes 20 in the lower part of the wall 30. Furthermore the tubes 20 within this part of the wall 30 have been bent so that they are displaced alternately a short distance forward and a short distance backward in relation to the parts of the tubes located in part of the wall 30 higher up, in order to increase the width of the intermediate openings 29.

For the purpose of recovering heat from the flue gases passing through the stack 12, an assembly of vertical convection tubes 31 is provided inside the stack. They extend along a considerable length of the flue gas stack and are arranged in a plurality of parallel rows. These tubes 31 are provided along parts of their length which are spaced from each other with external surface enlarging elements in the form of pins 32 which project in generally radial direction from the tubes, whereas other parts of the tubes, e.g. the intermediate parts designated D and E in FIG. 1, lack such surface enlarging elements. The purpose of the surface enlarging elements formed by the pins 32 is to increase heat absorption in the tubes 32 and thereby improve the efficiency of in the convection tube assembly formed thereby in the flue gas channel.

The convection tubes 31 form a flat coherent unit within each row. All of the tubes in one row are connected together at their upper ends by means of an upper horizontal header 33 and at their lower ends by means of a lower horizontal manifold 34. A panel tube 20 located opposite each convection tube unit in the panel tube wall situated at the rear of the flue gas stack 12 is also connected by its upper and lower end, respectively, to the header 33 and manifold 34 of said unit.

The headers 33 of the various convection tube units are connected individually to the steam drum 19, each by its own connecting pipe 35, while their manifolds 34 are connected individually to the stuff box 16, each by its own connecting pipe 36. Each convection tube unit will thus form a flow path, separated from the other units, between the stuff box 16 and steam drum 19, along which water can flow by means of autocirculation while absorbing heat from the flue gases passing through the flue gas stack 12.

The division of the convection tubes 31 into several parallel flat units as described above enables repair work or the exchange of a faulty tube to be carried out in a considerably simpler manner than has previously been possible. Once the appropriate part of the sheet metal casing 23 and the layer 22 of insulating material beneath the casing have been removed from the rear of the flue gas stack 12, it is easy to cut free the unit which includes the faulty tube and remove this unit for repair or to replace the tube. The unit can then be reinserted in its place in the flue gas stack 12 and welded to the steam drum 19 and the stuff box 16 by way of their connecting pipes 35 and 36, respectively.

Figure 2:
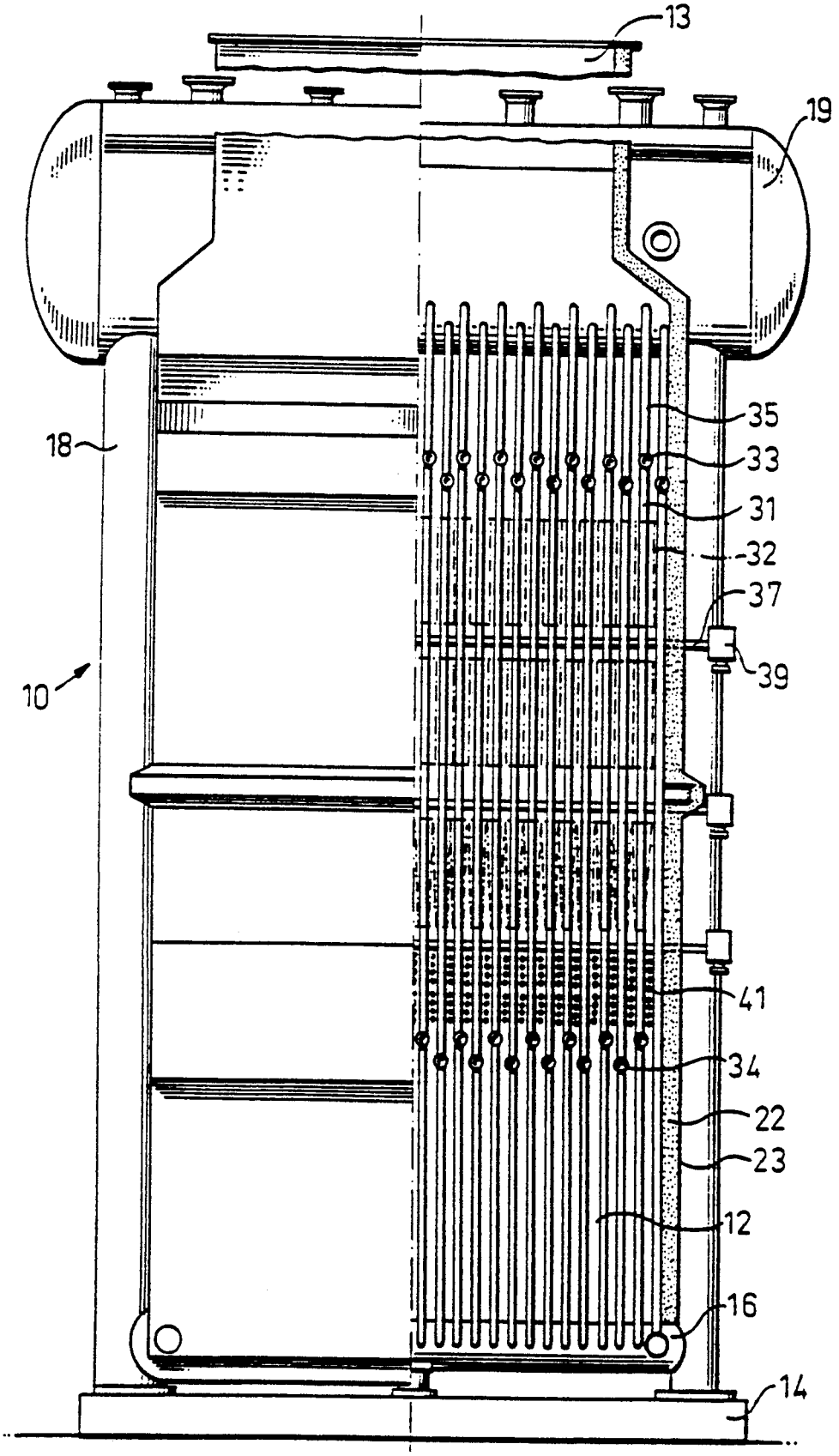
FIG. 2 shows a rear end view of the boiler, partly in section.
Figure 3:
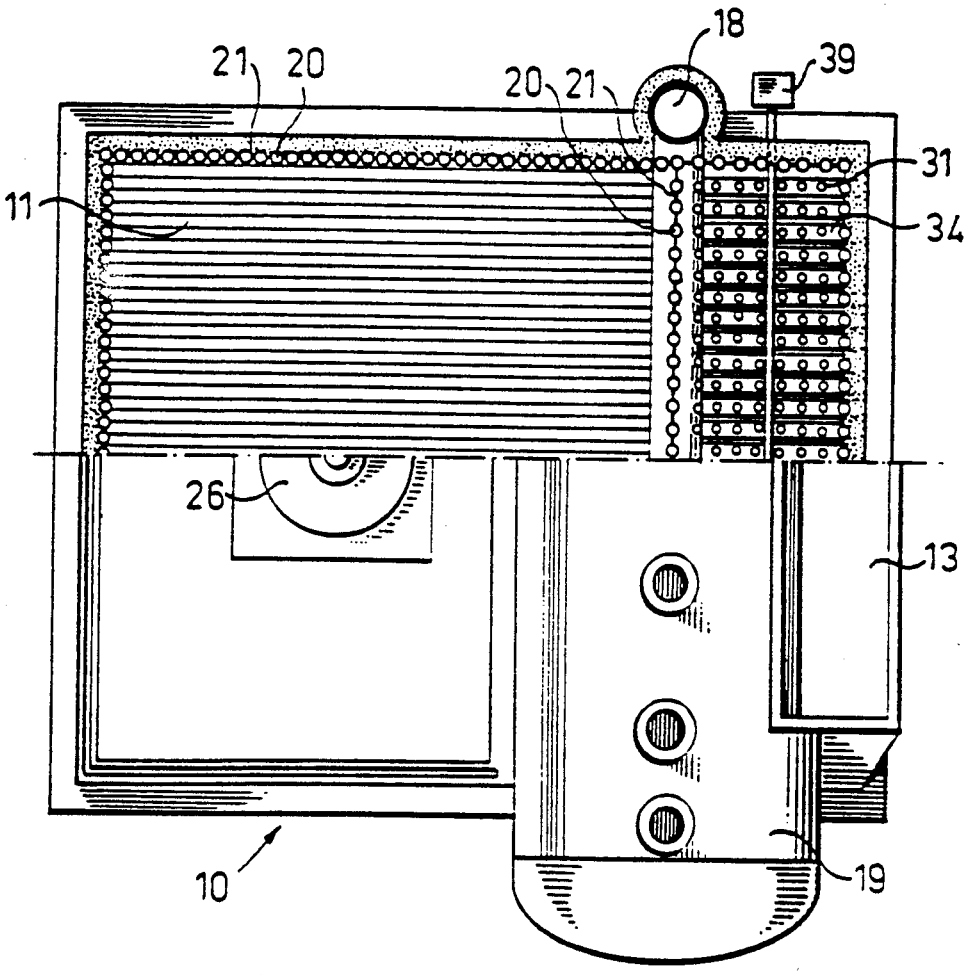
FIG. 3 shows a horizontal projection of the boiler, partly in section.

As can be seen in FIGS. 1 and 2, both the headers 33 and the manifolds 34 are arranged displaced alternately in upward and downward direction between the various convection tube units. The flow resistance of these pipes to the flue gases passing through the flue gas stack 12 is thus reduced.

The sections of the convection tubes 31 designated A, B and C in FIGS. 1 and 2 which are provided with pins 32 projecting from them to form surface enlarging elements, as indicated only schematically in said figures, may be constructed in the following manner.

Figure 4:
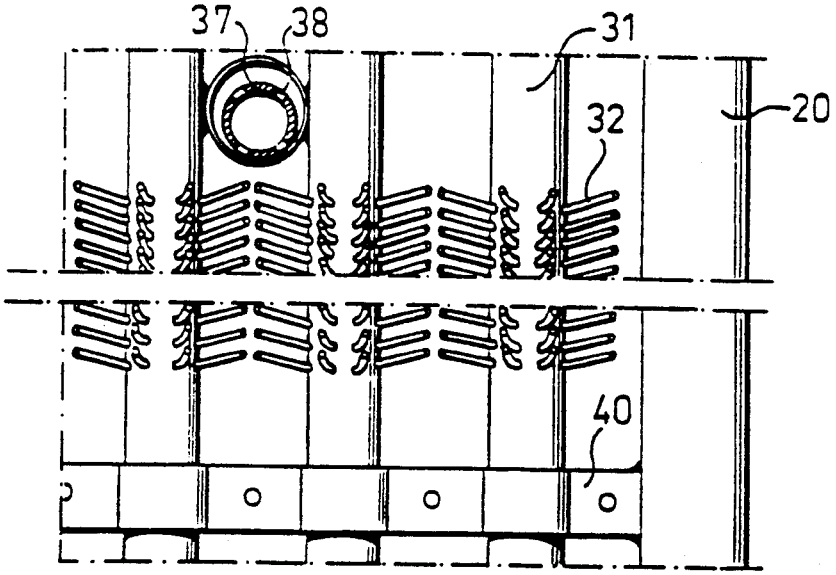
FIG. 4 shows a detail on a larger scale, revealing a central part of one of a plurality of convection tube units arranged in the vertical flue gas stack of a boiler.
Figure 5:
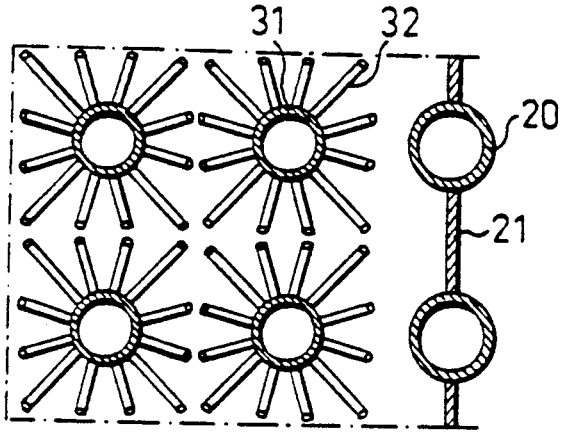
FIG. 5 shows a detail in section along the line V—V in FIG. 4.
Figure 7:
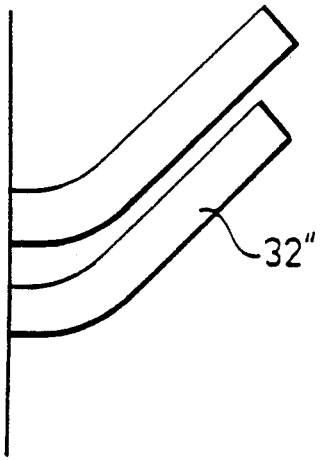
FIGS. 7 and 8 show details on an even larger scale, revealing more clearly the design of two different types of surface enlarging elements applied on the convection tubes.
Figure 8:
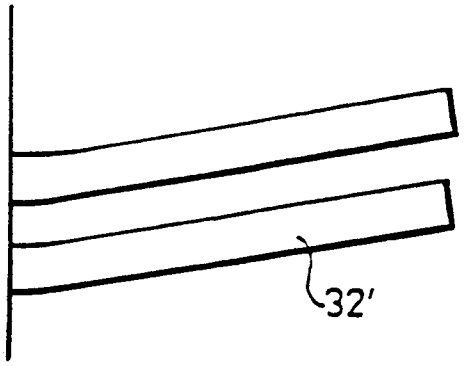

If the tubes 31 are arranged as shown in FIGS. 4 and 5 with equal spacing within each flat unit formed by a row of such tubes, and between the various units, the pins 32 along the two upper sections A and B of the tubes 31 may be constructed as shown in FIGS. 4 and 5. Here the outer ends of the pins 32, seen in the longitudinal direction of the tube 31, are situated along the sides of a described rectangle, wherein each tube 31 has four pins 32' of the type shown more clearly in FIG. 8 directed toward the corners of the rectangle and the pins 31' are longer than the pins 32'' situated between them, the pins 32'' being more clearly in FIG. 7. Both the pins 32' and the pins 32'' are bent so that they extend obliquely from the ends attached to the tube 31 toward the upper end of said tube. The shorter pins 32'', however, are bent considerably more than the longer pins 32'.

Figure 6:
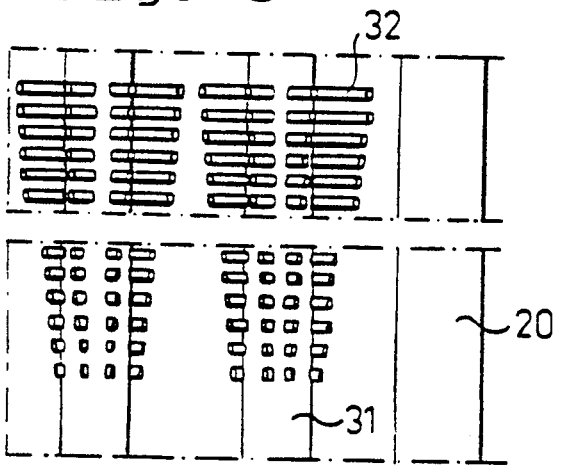
FIG. 6 shows a detail, similar to FIG. 4, but revealing a lower portion of a convection tube unit.

As shown in FIG. 6, within the lower section C of each tube 31, the pins 32 may decrease gradually in length toward the lower end of the tube 31 and extend radially outward from the tube in a direction perpendicular thereto. The reason for the special shape of the pins 32 located within section C is that the flue gases have an extremely high temperature when they reach this section and it is therefore suitably to give the pins a suitable length for this high temperature to ensure that they will not be subjected to injurious heating by the flue gases.

Within sections D end E of the convection tubes 31 located between sections A, B and C, and also within the lowermost section located under section C, soot blasting pipes 37 protrude into the flue gas stack 12. These pipes 37 are provided with a plurality of openings 38 distributed along their length and around their circumference, through which steam can be blown in between the tubes 31 from steam inlets 39 situated at the outer ends of the pipes.

A bracing means 40, shown more clearly in FIG. 4, is also provided within section E for mechanical connection of the individual tubes 31 in each unit to each other at a point situated approximately centrally between the tube ends along their length.

Finally, a superheater consisting of a plurality of horizontal pipe loops 41 is provided in the lowermost section of the convection tube assembly.

The invention is not limited to the embodiments described above and illustrated in the drawings. Many other embodiments are feasible within the scope of the invention. For example it may be mentioned that the pins 32 arranged on the convection tubes may be replaced by other types of suitable enlarging elements.

We claim:

1. A water tube boiler comprising a furnace having a burner for generating a flame in the furnace, lateral sides around the furnace, a substantially vertical, flue gas stack located close to one of the sides of the furnace; an inlet to the stack from the furnace for flue gases, the inlet located in the lower part of the furnace and the lower part of the stack; an outlet for flue gases located at the upper part of the stack;

a convection tube assembly is arranged in and extending vertically in the stack for recovering heat from the flue gases passing through the stack, the convection tube assembly comprising a plurality of parallel rows of substantially vertical convection tubes, the tubes extending along a substantial portion of the height of the stack; the respective tubes in each row being joined together to form a flat coherent unit, a respective upper, substantially horizontal header for each row of tubes and the header being connected at the upper ends of the tubes in the row, a respective lower and substantially horizontal manifold to which the lower ends of the tubes are connected;

a steam drum of the boiler to which the headers of the units are connected; a stuff box in the boiler to which the manifolds of the units are connected; and surface enlarging elements provided on the exteriors of the tubes along at least a portion of the height of the tubes in the stack.

2. The boiler of claim 1, wherein the furnace has an upper part in which the burner is located and the burner generating a generally downwardly directed flame into the furnace.

3. The boiler of claim 1, wherein the headers are individually connected to the steam drum and the manifolds are individually connected to the stuff box.

4. The boiler of claim 1, wherein in alternate units across the stack, both of the header and the manifold for a first one of the units is vertically upward with respect to the adjacent units and the header and the manifold for a second one of the units is vertically downward with respect to the adjacent units.

5. The boiler of claim 4, wherein in alternate tube units across the stack, the headers and manifolds are alternately spaced upward in one unit and downward in the next adjacent unit.

6. The boiler of claim 1, wherein the surface enlarging elements are provided on the convection tubes at selected ones of the portions along the height of the tubes and not at other portions along the height.

7. The boiler of claim 6, wherein the convection tubes are in a number of sections, with sections provided with the surface enlarging elements alternating with sections that are free of the surface enlarging elements.

8. The boiler of claim 1, wherein the distance of the divisions between the convection tubes is the same within each unit and between the various units.

9. The boiler of claim 1, wherein the surface enlarging elements comprise pins formed on the exterior of the convection tubes and projecting radially therefrom.

10. The boiler of claim 9, wherein the convection tubes are in a number of sections, with sections provided with the surface enlarging elements alternating with sections that are free of the surface enlarging elements.

11. The boiler of claim 10, wherein the pins on each tube project outwardly from the tube a distance so as to define a rectangle shape defined by the ends of the pins from the tube.

12. The boiler of claim 11, where on the parts of the tube having the pins, some of the pins project toward the corners of the rectangle and the pins directed to the corner project longer than the pins located between the pins projecting toward the corners of the rectangle.

13. The boiler of claim 12, wherein at least some of the pins on each convection tube are bent so that they extend obliquely toward the upper end of the tube.

14. The boiler of claim 11, wherein at least some of the pins in each convection tube are bent so that they extend obliquely toward the upper end of the tube.

15. The boiler of claim 9, wherein at least some of the pins in each convection tube are bent so that they extend obliquely toward the upper end of the tube.

* * * * *